US007663551B2

(12) United States Patent
Nissinen et al.

(10) Patent No.: US 7,663,551 B2
(45) Date of Patent: Feb. 16, 2010

(54) MULTIBAND ANTENNA APPARATUS AND METHODS

(75) Inventors: Pertti Nissinen, Kempele (FI); Petteri Annamaa, Oulunsalo (FI); Kimmo Koskiniemi, Oulu (FI)

(73) Assignee: Pulse Finald Oy (FI)

( * ) Notice: Subject to any disclaimer, the term of this patent is extended or adjusted under 35 U.S.C. 154(b) by 209 days.

(21) Appl. No.: 11/603,511

(22) Filed: Nov. 22, 2006

(65) Prior Publication Data

US 2007/0139277 A1 Jun. 21, 2007

(30) Foreign Application Priority Data

Nov. 24, 2005 (FI) ..... 20055621

(51) Int. Cl.
*H01Q 1/38* (2006.01)

(52) U.S. Cl. ..... 343/700 MS; 343/702

(58) Field of Classification Search ..... 343/700 MS, 343/702, 846, 829

See application file for complete search history.

(56) References Cited

U.S. PATENT DOCUMENTS

| | | | |
|---|---|---|---|
| 4,977,383 | A | 12/1990 | Niiranen |
| 5,047,739 | A | 9/1991 | Kuokkanen |
| 5,103,197 | A | 4/1992 | Turunen |
| 5,157,363 | A | 10/1992 | Puurunen |
| 5,159,303 | A | 10/1992 | Flink |
| 5,210,510 | A | 5/1993 | Karsikas |
| 5,239,279 | A | 8/1993 | Turunen |
| 5,278,528 | A | 1/1994 | Turunen |
| 5,281,326 | A | 1/1994 | Galla |
| 5,298,873 | A | 3/1994 | Ala-Kojola |
| 5,302,924 | A | 4/1994 | Jantunen |
| 5,304,968 | A | 4/1994 | Ohtonen |
| 5,307,036 | A | 4/1994 | Turunen |
| 5,319,328 | A | 6/1994 | Turunen |
| 5,349,315 | A | 9/1994 | Ala-Kojola |
| 5,351,023 | A | 9/1994 | Niiranen |
| 5,354,463 | A | 10/1994 | Turunen |
| 5,387,886 | A | 2/1995 | Takalo |
| RE34,898 | E | 4/1995 | Turunen |
| 5,408,206 | A | 4/1995 | Turunen |
| 5,418,508 | A | 5/1995 | Puurunen |

(Continued)

FOREIGN PATENT DOCUMENTS

DE 101 50 149 A1 4/2003

(Continued)

*Primary Examiner*—Tho G Phan
(74) *Attorney, Agent, or Firm*—Gazdzinski & Associates, PC

(57) ABSTRACT

A multiband antenna, and component for implementing a multiband antenna for, e.g., a small-sized radio device. In one embodiment, the antenna component comprises a simple and reliable dielectric substrate, the conductive coating of which forms a radiating element. This has a plurality (e.g., two) resonances for forming separate operating bands. The lower resonance is based on the entire element, and the upper resonance on the head part of the element. The conductive coating has a pattern, which functions as a parallel resonance circuit between the head part and the tail part of the element. The natural frequency of this parallel resonance circuit is in the range of the upper operating band of the antenna. The resonance frequencies of the antenna and thus its operating bands can be tuned independently of each other so that the tuning cycle need not be repeated.

45 Claims, 5 Drawing Sheets

U.S. PATENT DOCUMENTS

| | | | | |
|---|---|---|---|---|
| 5,432,489 | A | 7/1995 | Yrjola | |
| 5,467,065 | A | 11/1995 | Turunen | |
| 5,473,295 | A | 12/1995 | Turunen | |
| 5,506,554 | A | 4/1996 | Ala-Kojola | |
| 5,508,668 | A | 4/1996 | Prokkola | |
| 5,521,561 | A | 5/1996 | Yrjola | |
| 5,541,560 | A | 7/1996 | Turunen | |
| 5,543,764 | A | 8/1996 | Turunen | |
| 5,550,519 | A | 8/1996 | Korpela | |
| 5,570,071 | A | 10/1996 | Ervasti | |
| 5,585,771 | A | 12/1996 | Ervasti | |
| 5,594,395 | A | 1/1997 | Niiranen | |
| 5,604,471 | A | 2/1997 | Rattila | |
| 5,627,502 | A | 5/1997 | Ervasti | |
| 5,675,301 | A | 10/1997 | Nappa | |
| 5,689,221 | A | 11/1997 | Niiranen | |
| 5,717,368 | A | 2/1998 | Niiranen | |
| 5,731,749 | A | 3/1998 | Yrjola | |
| 5,734,305 | A | 3/1998 | Ervasti | |
| 5,734,351 | A | 3/1998 | Ojantakanen | |
| 5,739,735 | A | 4/1998 | Pyykko | |
| 5,742,259 | A | 4/1998 | Annamaa | |
| 5,793,269 | A | 8/1998 | Ervasti | |
| 5,815,048 | A | 9/1998 | Ala-Kojola | |
| 5,903,820 | A | 5/1999 | Hagstrom | |
| 5,905,475 | A | 5/1999 | Annamaa | |
| 5,990,848 | A | 11/1999 | Annamaa | |
| 6,014,106 | A | 1/2000 | Annamaa | |
| 6,016,130 | A | 1/2000 | Annamaa | |
| 6,023,608 | A | 2/2000 | Yrjola | |
| 6,037,848 | A | 3/2000 | Alila | |
| 6,078,231 | A | 6/2000 | Pelkonen | |
| 6,140,973 | A | 10/2000 | Annamaa | |
| 6,157,819 | A | 12/2000 | Vuokko | |
| 6,185,434 | B1 | 2/2001 | Hagstrom | |
| 6,215,376 | B1 | 4/2001 | Hagstrom | |
| 6,252,554 | B1 | 6/2001 | Isohatala | |
| 6,950,066 | B2 * | 9/2005 | Hendler et al. | 343/700 MS |
| 7,081,857 | B2 | 7/2006 | Kinnunen | |
| 7,099,690 | B2 | 8/2006 | Milosavljevic | |
| 7,126,546 | B2 | 10/2006 | Annamaa | |
| 7,136,019 | B2 | 11/2006 | Mikkola | |
| 7,340,286 | B2 | 3/2008 | Korva | |
| 7,352,326 | B2 | 4/2008 | Korva | |
| 7,391,378 | B2 | 6/2008 | Mikkola | |
| 2007/0152885 | A1 * | 7/2007 | Sorvala | 343/700 MS |
| 2008/0284661 | A1 * | 11/2008 | He | 343/700 MS |
| 2008/0316116 | A1 * | 12/2008 | Hobson et al. | 343/702 |

FOREIGN PATENT DOCUMENTS

| | | | |
|---|---|---|---|
| EP | 0 831 547 | A2 | 3/1998 |
| EP | 1 162 688 | A1 | 12/2002 |
| EP | 1 414 108 | A2 | 4/2004 |
| JP | 2001-217631 | | 10/2001 |
| WO | WO 00/36700 | | 6/2000 |
| WO | WO 02/11236 | A1 | 2/2002 |
| WO | WO 2004/112189 | A1 | 12/2004 |
| WO | WO 2006/000631 | A1 | 1/2006 |

* cited by examiner

MULTIBAND ANTENNA APPARATUS AND METHODS

PRIORITY AND RELATED APPLICATIONS

This application claims priority to Finland Patent Application No. 20055621 filed Nov. 24, 2005 and entitled "Multiband Antenna Component", which is incorporated herein by reference in its entirety.

This application is related to co-owned and co-pending U.S. patent application Ser. No. 11/544,173 filed Oct. 5, 2006 and entitled "Multi-Band Antenna With a Common Resonant Feed Structure and Methods", also incorporated herein by reference in its entirety.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

BACKGROUND OF THE INVENTION

1. Field of Invention

The invention relates to a dielectric antenna component, in one embodiment by which an internal multiband antenna of a small-sized radio device can be implemented. The invention also pertains to such an entire antenna.

2. Description of Related Technology

In many small-sized radio devices, such as most models of mobile phones, the antenna is placed inside the casing of the device for convenience. A very common internal antenna type is the planar antenna, which has a radiating plane and a ground plane, isolated from each other by air. Efforts are naturally made to make the internal antenna as small as possible. The size compared to an air-insulated antenna can be reduced by using dielectric material under the radiating plane. The central part of the antenna is then a chip component partly coated with conductive material, which can be mounted on the circuit board of a radio device. The higher the permittivity of the material is, the smaller the antenna element having a certain electrical size is physically.

When a radio device must operate in at least two systems, the frequency bands of which are relatively far from each other, the antenna structure becomes more complicated in comparison to a single-band antenna. One solution is to use two separate antennas for example in such a way that there is one chip-type antenna component for each band, in which case the bands can be formed and tuned independently of each other. However, the additional space required by the other antenna on the circuit board of the device is a drawback. In addition, the feed of the antennas from a shared antenna port requires additional components, which take their space and increase the costs.

FIG. 1 shows a typical prior art dielectric antenna (from the publication JP 2001217631), which can be implemented as a dual-band antenna. The antenna component is on the circuit board PCB of a radio device with its lower surface against the ground plane GND belonging to the circuit board. The component comprises a dielectric substrate 110 and two radiating antenna elements on its surface. The main element 120 covers part of the upper surface of the substrate 110. The feed conductor 111 of the antenna runs on a side surface of the substrate and joins galvanically the main element at its one end. The other antenna element 130 is parasitic. It covers another part of the upper surface of the substrate and is galvanically coupled to the ground plane by a short-circuit conductor 112 running beside the feed conductor. In addition, the main element extends to the end surface of the substrate, and the parasitic element to the opposite end surface, on which end surfaces they have a capacitive coupling to the ground GND for increasing the electrical size of the element. Between the main and the parasitic element there is a slot on the upper surface of the substrate, over which the parasitic element obtains its feed electromagnetically.

The lower operating band of the antenna is based on the resonance of the main element 120, and the upper operating band is based on the resonance of the smaller parasitic element 130. In addition, the harmonic frequency of the main element can be utilized in certain cases by arranging it in the range of the upper operating band for widening it. The harmonic ratio can be adjusted by means of perforation provided in the basic element. The parasitic element is also perforated, which provides one possibility for tuning the resonance frequency of the parasitic element.

The component included in the solution according to FIG. 1 has the drawback that for a dielectric antenna component, it is relatively large-sized and hence consumes considerable space (and may have appreciable weight). Furthermore, the tunings of the antenna elements have an effect on each other, which makes tuning more difficult and increases production costs.

Accordingly, it would be desirable to provide an improved antenna component (and antenna) solution that is space efficient, and which substantially decouples the antenna elements in order to facilitate easier tuning and matching.

SUMMARY OF THE INVENTION

The present invention addresses the foregoing needs by disclosing apparatus and methods for a multiband antenna, including an antenna component.

In a first aspect of the invention, an antenna is disclosed. In one embodiment, the antenna comprises a multi-band antenna comprising: a dielectric element having a longitudinal direction and a transverse direction, said element being deposited at least partially on a ground plane; a conductive coating deposited on the dielectric element, the conductive coating having a first portion and a second portion; a feed structure coupled to the conductive coating; and a resonant structure formed between the first portion and the second portion to electrically isolate the first portion and the second portion at a first frequency, and to form first and second resonators. In one variant, said first resonator is formed between the first portion and the ground plane, and is structured so as to operate within the first frequency band, while the second resonator is formed between the first portion and the second portion and the ground plane, and is structured so as to operate within a second frequency band.

In another variant, the resonant structure comprises: a conductive element that connects the first portion to the second portion along at least one adjacent edge of the first and second portions; and a capacitive element to at least partly resonate with the conductive element.

In another embodiment, the antenna comprises: an antenna component having a dielectric substrate and a conductive layer, the conductive layer forming a radiating element having at least first and second resonances for implementing at least first and second operating bands respectively; wherein the first resonance is based on substantially all of the radiating element; and wherein the second resonance is based on only a portion of the radiating element.

In a second aspect of the invention, a radio frequency device is disclosed. In one embodiment, the device comprises: a multi-band antenna deposited on a dielectric substrate, the multi-band antenna comprising a first portion and a second portion; a feed structure coupled to the at least one of the first portion and the second portion; and a resonant structure formed between the first portion and the second portion to electrically isolate the first portion and the second portion within a first frequency band, and to form a first resonator and a second resonator. The first resonator and the second resonator are substantially electrically isolated from each another with respect to at least frequency tuning.

In a third aspect of the invention, a multi-band antenna is disclosed. The antenna is manufactured according to the method comprising: mounting a dielectric substrate at least partially on a ground plane; disposing conductive material as a first portion and a second portion on the dielectric substrate; disposing a resonant structure between the first portion and the second portion to produce a first resonator and a second resonator; and disposing a feed structure on at least one of the first portion and the second portion.

In a fourth aspect of the invention, a mobile radio frequency device is disclosed. In one embodiment, the device comprises: a transceiver; and an antenna in signal communication with said transceiver, said antenna having: a first conductive portion deposited on a dielectric substrate; a second conductive portion deposited on the dielectric substrate; and a resonant structure formed between the first conductive portion and the second conductive portion; wherein the first conductive portion forms, with the dielectric substrate, a first resonator that resonates within a first frequency band.

In a fifth aspect of the invention, a method of tuning a multiband antenna having at least first and second operating frequency bands is disclosed. In one embodiment, the antenna comprises first and second portions of a radiating element, and the method comprises: varying the electrical size of the first portion of the radiating element to achieve tuning of the first operating band; varying the electrical size of the second portion of the radiating element to achieve tuning of the second operating band. Varying the electrical size of the second portion does not significantly affect the tuning of the first operating band.

In a sixth aspect of the invention, an antenna component for implementing an antenna of a radio device is disclosed. In one embodiment, the antenna has at least a lower and an upper operating band, and the component comprises: a dielectric substrate with a longitudinal and a transverse direction; and a conductive coating of the substrate forming a radiating element having a feed end for signal communication with a feed conductor of the antenna. The radiating element is formed into at least a head part and a tail part, said head part proximate said feed end, said head and tail parts being coupled to each other only through at least one interconnecting conductor formed from the conductive coating of the substrate, said at least one conductor providing an inductance between the head part and the tail part, said head and tail parts further being capacitively coupled to each other via at least one non-conductive slot on the substrate.

In a seventh aspect of the invention, a radio device is disclosed. In one embodiment, the device comprises a circuit board, a conductive surface of which functions as a ground plane, and an antenna, the antenna comprising an antenna component having at least a lower and an upper operating band, said component comprising: a dielectric substrate with a longitudinal and a transverse direction; and a conductive coating of the substrate forming a radiating element having a feed end for signal communication with a feed conductor of the antenna. The radiating element is formed into at least a head part and a tail part, said head part proximate said feed end, said head and tail parts being coupled to each other only through at least one interconnecting conductor formed from the conductive coating of the substrate, said at least one conductor providing an inductance between the head part and the tail part, said head and tail parts further being capacitively coupled to each other via at least one non-conductive slot on the substrate. The antenna component is disposed substantially on the circuit board with its lower surface against the circuit board and with the feed end of the radiating element is connected to the feed conductor of the antenna.

In another aspect of the invention, an improved mobile communication device is disclosed. In one embodiment, the device comprises a cellular telephone or personal communication device comprising the aforementioned multiband antenna (with antenna component).

In another aspect of the invention, a method of operating a multiband antenna is disclosed. In one variant, the method comprises disposing said antenna within a mobile communication device; and performing at least one of transmitting or receiving a signal within one or more of the multiple frequency bands associated with the antenna.

These and other aspects of the invention shall become apparent when considered in light of the disclosure provided herein.

BRIEF DESCRIPTION OF THE DRAWINGS

In the following, the invention will be described in detail. Reference will be made to the accompanying drawings, in which.

DETAILED DESCRIPTION OF THE INVENTION

Figure 1:
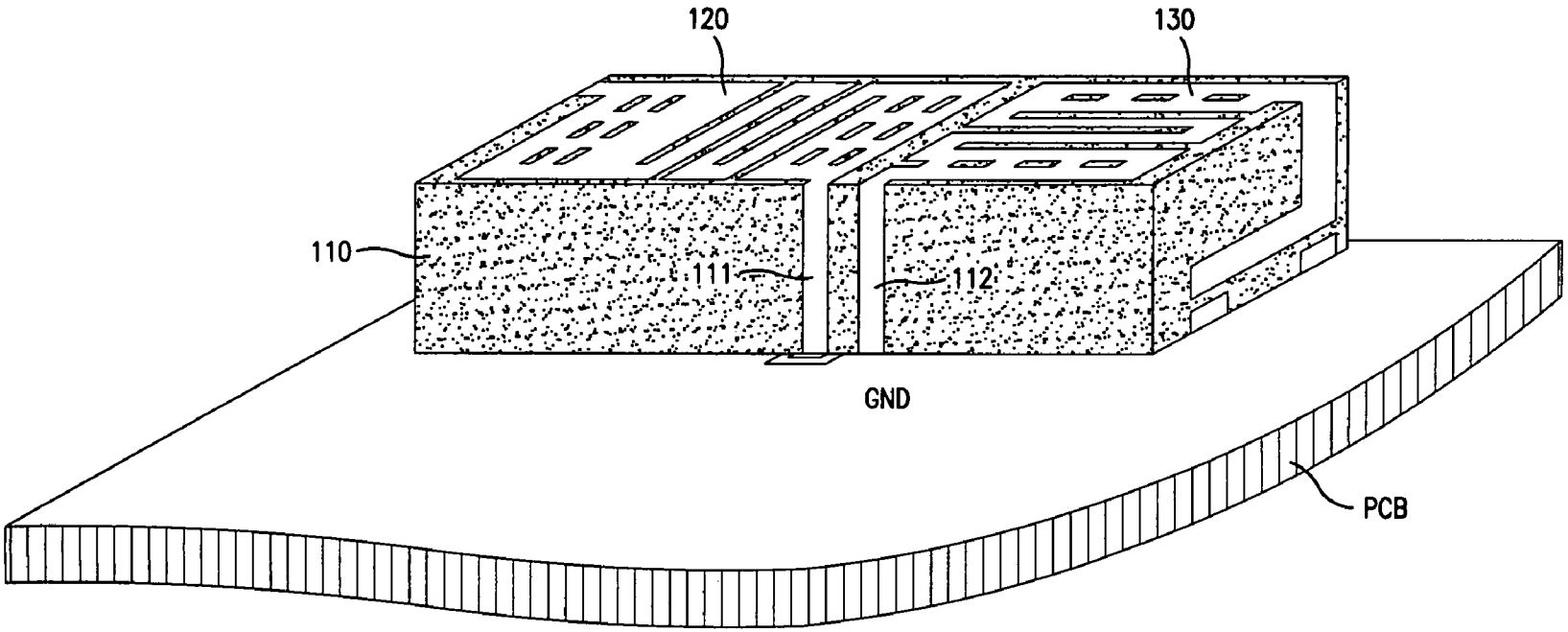
FIG. 1 PRIOR ART
FIG. 1 is a perspective view of an example of a prior art multiband antenna.

Reference is now made to the drawings wherein like numerals refer to like parts throughout.

As used herein, the terms "wireless", "radio" and "radio frequency" refer without limitation to any wireless signal, data, communication, or other interface or radiating component including without limitation Wi-Fi, Bluetooth, 3G (3GPP/3GPPS), HSDPA/HSUPA, TDMA, CDMA (e.g., IS-95A, WCDMA, etc.), FHSS, DSSS, GSM, UMTS, PAN/

802.15, WiNMAX (802.16), 802.20, narrowband/FDMA, OFDM, PCS/DCS, analog cellular, CDPD, satellite systems, millimeter wave, or microwave systems.

Overview

In one salient aspect, the present invention discloses an improved multiband antenna configuration that provides several advantages over prior art approaches. In the exemplary embodiment of this antenna, the central part of the antenna comprises an antenna component having a dielectric substrate. The conductive coating of the substrate forms a radiating element, which has two resonances for implementing two separate operating bands. The lower resonance is based on the entire element and the upper resonance on the head part of the element as seen from the feed end. The conductive coating has a pattern, which functions as a parallel resonance circuit between the head and tail part of the element. The natural frequency of this parallel resonance circuit is in the range of the upper operating band of the antenna.

The exemplary embodiment has the advantage that, inter alia, only one radiating element and one feed is needed in a multiband antenna. In addition, the resonance frequencies of the antenna (and thus its operating bands) can be tuned to the desired values independently of each other so that the tuning cycle need not be repeated. This is due to the fact that because of the parallel resonance circuit, the tail part of the element becomes electrically isolated from the head part at the frequencies of the upper operating band. The upper operating band can then be tuned first by influencing the resonance frequency of the head part of the radiating element, and the lower operating band then by influencing the tail part of the radiating element.

Furthermore, the invention has the advantage that the space required by the antenna is relatively small because of the small size of the antenna component. This again is due to the fact that the radiating element is partly shared between the operating bands, and the permittivity of the substrate can be chosen as relatively high.

Yet another advantage of the invention is the fact that the structure according to it is comparatively simple and reliable.

Description of Exemplary Embodiments

Detailed discussions of various exemplary embodiments of the invention are now provided. It will be recognized that while described in terms of particular applications (e.g., mobile devices including for example cellular telephones), materials, components, and operating parameters (e.g., frequency bands), the various aspects of the invention may be practiced with respect to literally any wireless or radio frequency application.

Figure 2:
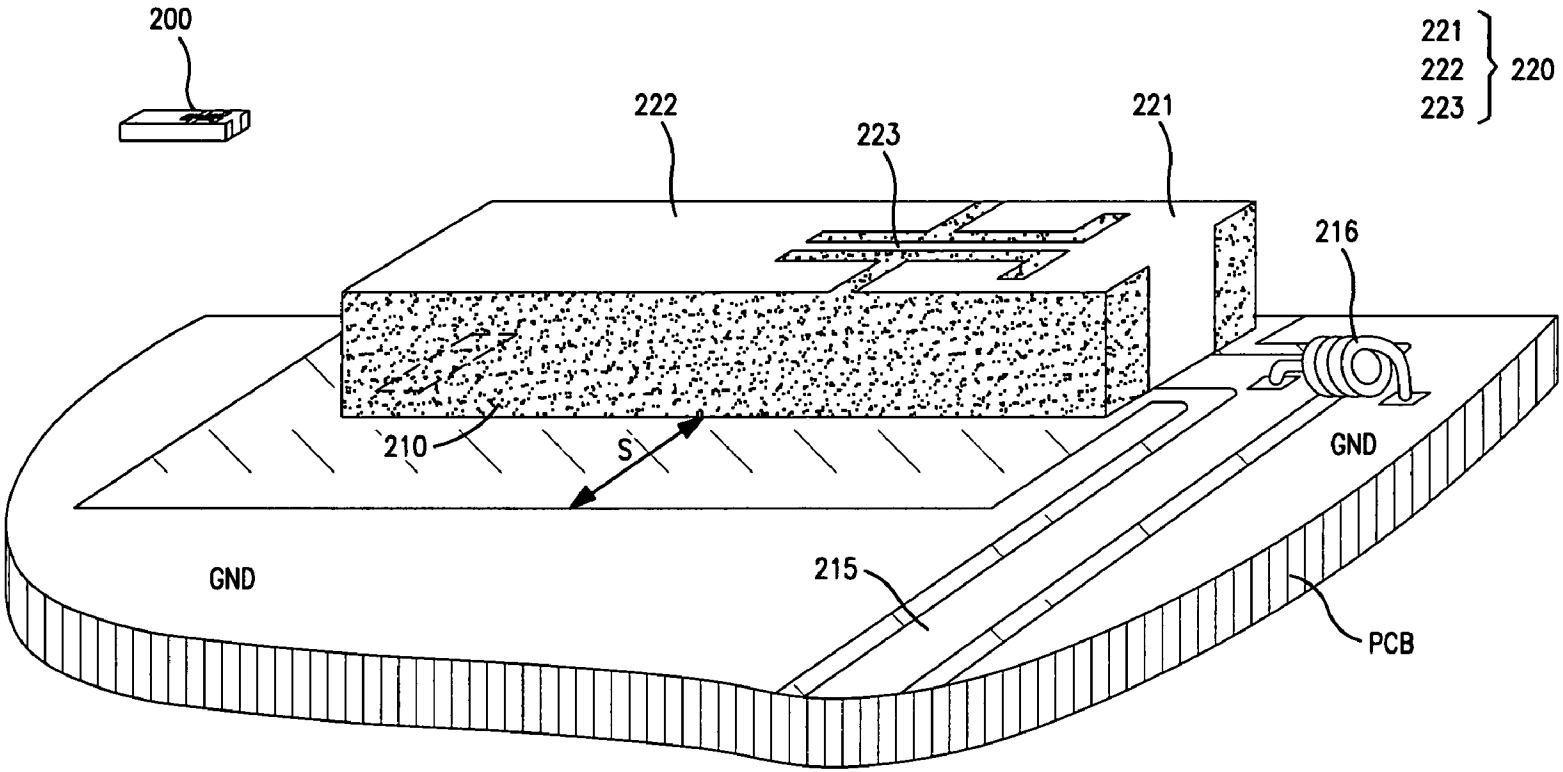
FIG. 2 is a perspective view illustrating one exemplary embodiment of an antenna component and a multiband antenna according to the invention.

FIG. 2 presents a first exemplary embodiment of an antenna component and a multiband antenna configured according to the invention. A part of the circuit board PCB of a radio device and an antenna component 200 on its surface are seen as enlarged in the figure. The antenna component comprises an elongated dielectric substrate 210 and its conductive coating 220, which functions as a radiating antenna element. It is for the most part located on the upper surface of the substrate, but extends by way of one end of the substrate to its lower surface, where the conductive coating forms a contact for connecting the antenna element electrically to the feed conductor 215 of the antenna. The end of the antenna element to be connected to the feed conductor is called the feed end.

The antenna of the example has two operating bands, the lower and the upper. In order to form these, it naturally has two significant resonances. It is substantial for the invention that these resonances, which are the basis of the radiation, are relatively independent of each other, although there is only one antenna element. The antenna element 220 is shaped so that as viewed from its feed end, it is "seen" as smaller at the frequencies of the upper operating band than on the lower frequencies. The pattern of the antenna element divides it, starting from its feed end, to the head part 221 and the tail part 222 in a way that there is inductance and capacitance parallelly disposed between these parts. The inductance is caused by a narrow interconnecting conductor 223, through which only the head part and the tail part are galvanically connected to each other. In this example, the interconnecting conductor is straight and follows the longitudinal direction of the substrate on the central area of its upper surface as viewed in the transverse direction.

The capacitance is caused by the head part and the tail part extending close to each other at the interconnecting conductor on both sides thereof. Because of the inductance and the capacitance, there is functionally a parallel resonance circuit between the head part and the tail part of the antenna element. The pattern of the element has been designed such that the resonance frequency of this parallel resonance circuit is in the range of the upper operating band of the antenna. It follows from this that at the frequencies of the upper operating band, there is a high impedance between the head part and the tail part, and consequently the tail part is electrically isolated from the head part and the antenna feed. Together with the substrate and the ground plane, the head part forms a quarter-wave resonator, which is in resonance in the upper operating band.

The equivalent circuit of the antenna is formed by the impedance in resonance of the resonator based on the head part only, or by the radiation resistance of the corresponding radiator in an ideal case. At the frequencies of the lower operating band, the impedance of the paralleled resonance circuit is low, in which case the head part and the end part form a functionally united radiator. Together with the substrate and the ground plane, the whole radiator 220 forms a quarter-wave resonator, which is in resonance in the lower operating band. The lower operating band is then based on the resonance of the whole radiating element.

On grounds of the above, the tuning of the antenna does not require repeated tuning steps in the nature of iteration. First is tuned the upper operating band by influencing the electrical size of the head part of the radiating element in some way. Then the lower operating band is tuned by influencing the electrical size of the end part of the radiating element in some way. The latter tuning does not have an effect on the former.

In addition, a separate coil 216 connected between the feed conductor 215 and the ground near the feed end of the radiating element 220 is seen in FIG. 2. The purpose of the coil is to optimize the matching of the antenna, and it is not needed at all in every case. In the example of FIG. 2, the antenna has also been matched by removing the ground plane from an area under and beside the antenna component up to a certain distance s. In this way, the bandwidths of the antenna can be increased. The ground plane can also be extended below the antenna component, the result being an antenna with a relatively narrow band but a good matching. The shaping of the ground plane naturally also has an effect on the resonance frequencies of the antenna; the longer the distance s, the higher the resonance frequencies.

Figure 3:
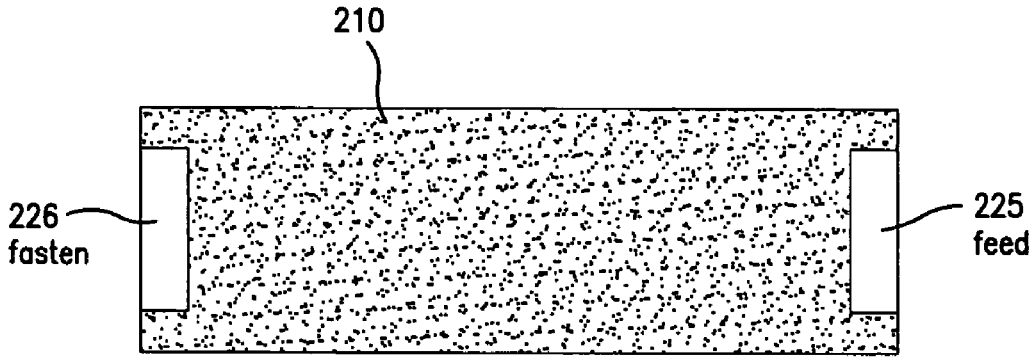
FIG. 3 is bottom elevational view of the antenna component according to FIG. 2.

FIG. 3 shows an antenna component 200 according to FIG. 2 as seen from below. On the lower surface of the substrate 210, at its each end, there is a conductive area. One 225 of them is the extension of the radiating element described above for connecting the element to the feed conductor. The other conductive area 226 at the opposite end is for fastening the antenna component to the circuit board by soldering. Naturally, the conductive area at the feed end serves also this purpose.

Figure 4:
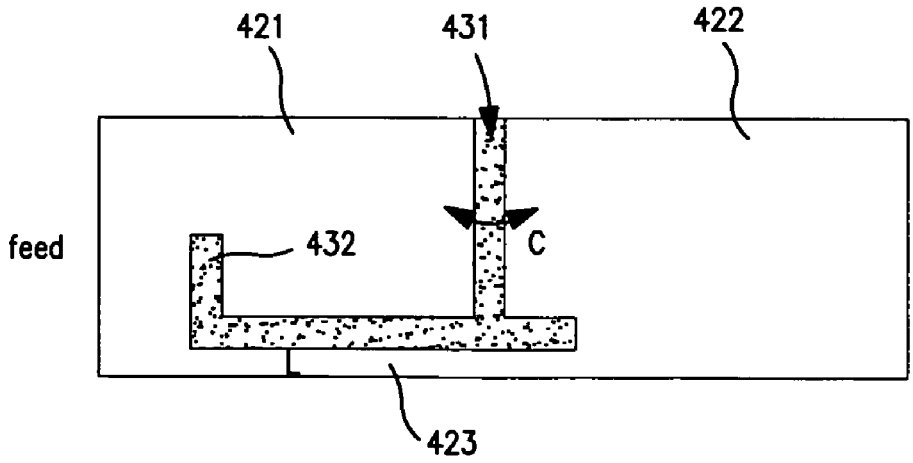
FIG. 4 shows another exemplary embodiment of the shaping of a radiating element in the antenna component according to the invention.

In FIG. 4 there is shown another example of the shaping of the radiating element in the antenna component according to the invention. The component is seen from above in the drawing. The interconnecting conductor 423 between the head part 421 and the end part 422 of the radiating element is straight and runs in the longitudinal direction of the component, and is located on the edge of the upper surface of the substrate. The interconnecting conductor has a certain inductance L. A relatively narrow non-conductive slot 431 extends transversely to the opposite edge of the upper surface of the substrate from the non-conductive area, which separates the interconnecting conductor from the rest of the element. Between the head part and the tail part, there is a certain capacitance C over that slot. In addition, on the upper surface of the substrate there is a transverse non-conductive area 432 on the side of the head part 421 and shaping it, as an extension of the area which separates the interconnecting conductor from the rest of the element. The electrical size of the head part is increased by means of such shapings, in which case the corresponding operating band shifts downwards.

Figure 5:
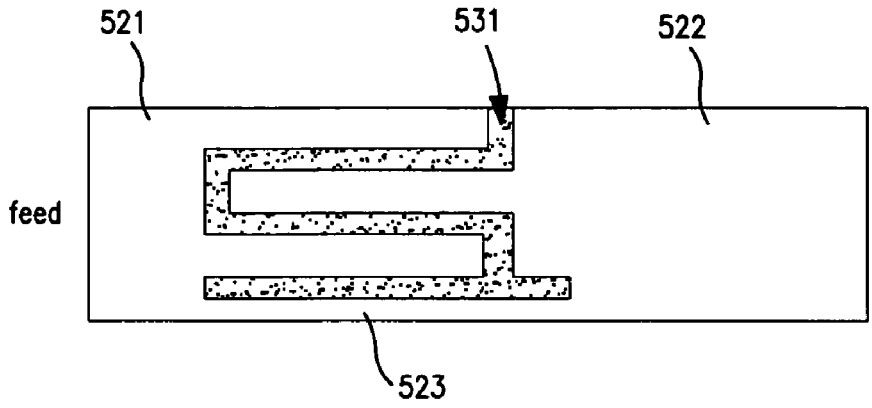
FIG. 5 shows a third exemplary embodiment of the shaping of the radiating element in the antenna component according to the invention.

In FIG. 5 there is shown a third example of the shaping of the radiating element in the antenna component according to the invention. Also in this example, the interconnecting conductor 523 between the head part 521 and the end part 522 of the radiating element is straight and runs in the longitudinal direction of the component, and is located on the edge of the upper surface of the substrate. To form a capacitance, a relatively narrow non-conductive slot 531 extends again to the opposite edge of the upper surface of the substrate from the non-conductive area, which separates the interconnecting conductor from the rest of the element. In this example, this slot makes a relatively long diversion to the side of the head part 521 so that a finger-like projection extends from the tail part 522 between the areas belonging to the head part. A shaping like this increases the capacitance between the head part and the end part.

Figure 6:
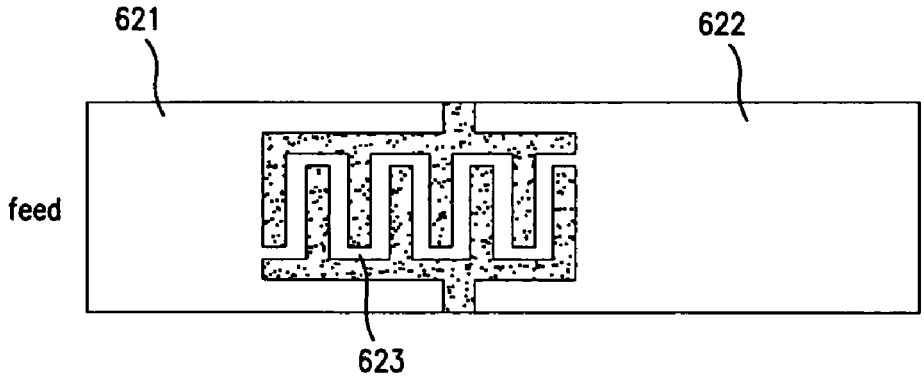
FIG. 6 shows a fourth exemplary embodiment of the shaping of the radiating element in the antenna component according to the invention.

In FIG. 6 there is a fourth example of the shaping of the radiating element in the antenna component according to the invention. In the interconnecting conductor 623 between the head part 621 and the end part 622 of the radiating element there are bends shaped like a meander pattern in this example, and it is located in the central area of the upper surface of the substrate. That kind of a shaping increases the inductance between the head part and the end part. From the non-conductive area, which separates the interconnecting conductor from the rest of the element, a relatively narrow and short non-conductive slot extends to each longitudinal edge of the upper surface of the substrate at the interconnecting conductor to form a capacitance.

Figure 7:
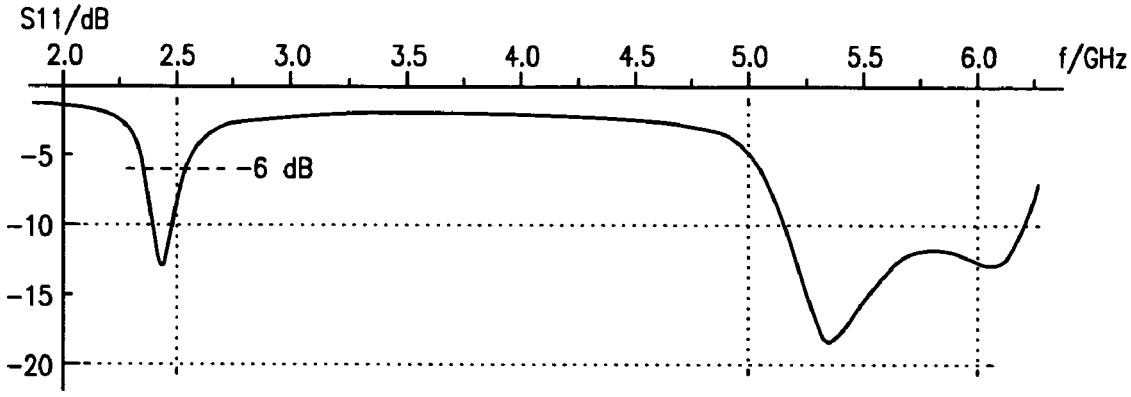
FIG. 7 is a graph showing an exemplary matching plot (reflectivity versus frequency) for one embodiment of the antenna according to the invention.

FIG. 7 presents an example of the matching of an antenna according to the invention. It shows the curve of the reflection coefficient S11 as a function of frequency. The curve is measured from an antenna according to FIG. 2, in which the substrate of the antenna component is of a ceramic material and sized $10 \cdot 3 \cdot 1.5$ mm$^3$. The component is located at the edge of a circuit board sized $3.7 \cdot 9$ cm$^2$ approximately in the middle of one of the long sides. The distance s seen in FIG. 2 from the side of the component to the edge of the ground plane is approximately 2 mm. The inductance of a separate matching coil is 2.2 nH. The antenna is dimensioned for the purposes of the WLAN (Wireless Local Area Network). The lower operating band is about 2.35-2.55 GHz, and the reflection coefficient in the middle of the operating band is about −13 dB. The upper operating band is even relatively very wide, approximately 5.1-6.3 GHz, and the reflection coefficient is better than −10 dB in a range having the width of one gigahertz.

Figure 8:
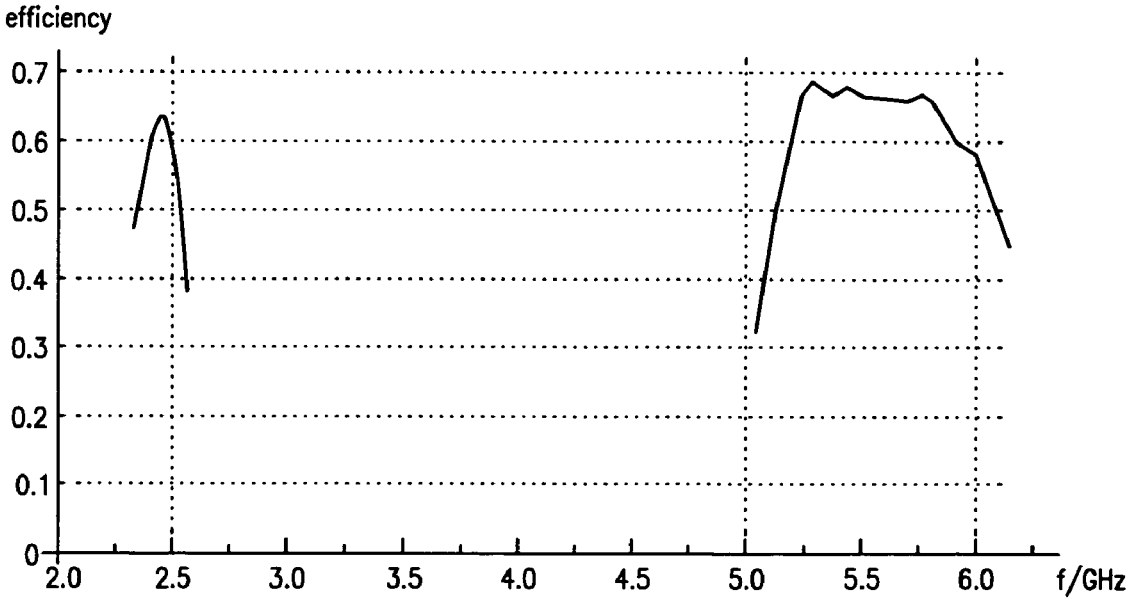
FIG. 8 is a graph showing an exemplary efficiency plot (efficiency versus frequency) for one embodiment of the antenna according to the invention.

FIG. 8 presents an example of the efficiency of an antenna according to the invention. The efficiency curve is measured from the same antenna as the curve of the reflection coefficient in FIG. 7 It is seen that in the lower operating band the efficiency is better than 0.5 and in the upper operating band better than 0.6. These are considerably high values for an antenna using a dielectric substrate.

It has been found be the Assignee hereof that by placing the antenna on the circuit board at the end of the board instead of the long side, its characteristics are slightly deteriorated in the lower operating band and remain the same in the upper operating band.

In this description and the claims, the qualifiers "lower", "upper" and "from above" refer to a relative position of the device, in which the antenna component is on top of a horizontal circuit board. Naturally, the antenna can be in any relative or absolute position when used.

An antenna component and an antenna according to the invention have been described above. Their structural parts may differ in the details from those presented. For example, the shape of the antenna element can vary greatly.

While the above detailed description has shown, described, and pointed out novel features of the invention as applied to various embodiments, it will be understood that various omissions, substitutions, and changes in the form and details of the device or process illustrated may be made by those skilled in the art without departing from the invention. The foregoing description is of the best mode presently contemplated of carrying out the invention. This description is in no way meant to be limiting, but rather should be taken as illustrative of the general principles of the invention. The scope of the invention should be determined with reference to the claims.

What is claimed is:

1. An antenna comprising:

a dielectric element having a longitudinal direction and a transverse direction, said element being deposited at least partially on a ground plane;

a conductive coating deposited on the dielectric element, the conductive coating having a first portion and a second portion, wherein all of said second portion and at least a radiating part of said first portion are disposed substantially within the same plane;

a feed structure coupled to the conductive coating; and a resonant structure formed between the first portion and the second portion to electrically isolate the first portion and the second portion at a first frequency, and to form first and second resonators.

2. The antenna of claim 1, wherein said first resonator is formed between the first portion and the ground plane, and is structured so as to operate within the first frequency band.

3. The antenna of claim 2, wherein said second resonator is formed between the first portion and the second portion and the ground plane, and is structured so as to operate within a second frequency band.

4. The antenna according to claim 3, wherein an edge of the ground plane disposed at a specified distance from the antenna is used to at least one of match and tune the antenna within at least one of the first frequency band and the second frequency band.

5. The antenna of claim 3, wherein the first resonator comprises a quarter-wave resonator resonant within the first frequency band and the second resonator comprises a quarter-wave resonator resonant within the second frequency band.

6. The antenna of claim 1, wherein the resonant structure comprises:

a conductive element that connects the first portion to the second portion along at least one adjacent edge of the first and second portions; and a capacitive element to at least partly resonate with the conductive element.

7. The antenna of claim 6, wherein the capacitive element is disposed substantially between edges of the first and the second portions that are adjacent to the conductive element.

8. The antenna of claim 6, wherein the conductive element comprises a meandered conductive trace adapted to produce a selected inductance value.

9. The antenna of claim 6, wherein the capacitive element comprises a non-conductive slot having at least one bend to increase a capacitance value between the first portion and the second portion.

10. The antenna of claim 1, wherein the dielectric element comprises a substrate comprising a ceramic material.

11. The antenna of claim 1, wherein the first resonator comprises a quarter-wave resonator resonant within a first frequency band and the second resonator comprises a quarter-wave resonator resonant within a second frequency band.

12. The antenna of claim 1, further comprising a coil electrically disposed between the feed structure and the ground plane to provide frequency tuning of the antenna.

13. A radio frequency device comprising:

a multi-band antenna deposited on a dielectric substrate, the multi-band antenna comprising a first portion and a second portion;

a ground structure;

a feed structure coupled to at least one of the first portion and the second portion, said feed structure and said ground structure forming a single connection; and a resonant structure formed between the first portion and the second portion to electrically isolate the first portion and the second portion within a first frequency band, and to form a first resonator and a second resonator;

wherein the first resonator and the second resonator are substantially electrically isolated from each another with respect to at least frequency tuning.

14. The device of claim 13, wherein said first resonator is formed between the first portion and the ground plane, and configured to operate within the first frequency band.

15. The device of claim 14, wherein said second resonator is formed between at least one of the first portion and the second portion and the ground plane, and configured to operate within a second frequency band lower in frequency than that of said first frequency band.

16. The device of claim 13, wherein the resonant structure comprises:

at least one conductive element connected to the first portion and the second portion along at least one contiguous edge of the first and the second portions; and at least one capacitive element resonant with the at least one conductive element.

17. The device of claim 13, wherein the resonant structure comprises at least one capacitive element formed between edges of the first and the second portions.

18. The device of claim 13, wherein the resonant structure comprises:

an interconnecting conductor extended along a longitudinal direction of the dielectric substrate, and a non-conductive slot formed on at least one side of the interconnecting conductor.

19. A multi-band antenna manufactured according to the method comprising:

mounting a dielectric substrate at least partially on a ground plane, wherein said ground plane is arranged a certain distance away from said dielectric substrate at least on one side;

disposing conductive material as a first portion and a second portion on the dielectric substrate;

disposing a resonant structure between the first portion and the second portion to produce a first resonator and a second resonator; wherein said first portion and said second portion are arranged to create inductance and capacitance parallelly disposed in between said first and second portions; and disposing a feed structure on at least one of the first portion and the second portion.

20. The antenna of claim 19, wherein the resonant structure substantially isolates at least one of (i) frequency response, and (ii) tuning, of the first resonator from that of the second resonator.

21. The antenna of claim 20, wherein the act of disposing a resonant structure comprises disposing said resonant structure:

to form said first resonator between the first portion and the ground plane, said first resonator being adapted to operate within a first frequency band; and to form said second resonator between both the first portion and the second portion and the ground plane, said second resonator being adapted to operate within a second frequency band.

22. The antenna of claim 21, wherein said disposing a resonant structure comprises disposing a conductive element coupling the first portion and the second portion;

wherein the conductive element and adjacent edges of the first and the second portions form a capacitive element that resonates within said first frequency band.

23. The antenna of claim 19, wherein said disposing a resonant structure comprises forming a conductive element that connects the first portion to the second portion along at least one adjacent edge of the first and the second portions.

24. The antenna of claim 19, wherein said disposing a resonant structure comprises disposing a conductive element coupling the first portion and the second portion;

wherein the conductive element and adjacent edges of the first and the second portions form a capacitive element that resonates within a first frequency band.

25. A mobile radio frequency device comprising:

a transceiver; and an antenna in signal communication with said transceiver, said antenna having:

a first conductive portion deposited on a dielectric substrate;

a second conductive portion deposited on the dielectric substrate, wherein all of said second portion and at least the radiating part of said first portion are disposed substantially within the same plane; and a resonant structure formed between the first conductive portion and the second conductive portion;

wherein the first conductive portion forms, with the dielectric substrate, a first resonator that resonates within a first frequency band.

26. The device of claim 25, wherein the first and the second conductive portions together form, with the dielectric substrate, a second resonator that resonates within a second frequency band lower than said first band.

27. The device of claim 26, wherein at least a portion of the first resonator is substantially electrically isolated from the second resonator.

28. The device of claim 27, further comprising a ground plane;

wherein an edge of said ground plane is disposed at a specified distance from the antenna to tune a frequency response of the antenna within at least one of the first frequency band and the second frequency band.

29. The device of claim 27, wherein the first resonator comprises a quarter-wave resonator resonant within the first frequency band, and the second resonator comprises a quarter-wave resonator resonant within the second frequency band.

30. The device of claim 27, further comprising a feed conductor and a coil;

wherein the coil is connected between the feed conductor and a ground plane to tune a frequency response of the antenna within at least one of the first frequency band and the second frequency band.

31. An antenna component for implementing an antenna of a radio device, the antenna having at least a lower and an upper operating band, said component comprising:

a dielectric substrate with a longitudinal and a transverse direction; and a conductive coating of the substrate forming a radiating element having a feed end for signal communication with a feed conductor of the antenna;

wherein the radiating element is formed into at least a head part and a tail part, said head part proximate said feed end, said head and tail parts being coupled to each other only through at least one interconnecting conductor formed from the conductive coating of the substrate, said at least one conductor providing an inductance between the head part and the tail part, said head and tail parts further being capacitively coupled to each other via at least one non-conductive slot on the substrate;

wherein a resonance frequency of a parallel resonance circuit formed by said at least one conductor and said capacitive coupling is disposed in the range of said upper operating band so as to substantially separate the tail part electrically from the head part at the upper operating band.

32. The antenna component of claim 31, wherein the upper operating band is based at least in part on a resonance of the head part, and the lower operating band is based at least in part on a resonance of the entirety of said radiating element.

33. The antenna component of claim 31, wherein said at least one conductor is substantially straight and runs in said longitudinal direction of the substrate in substantially central area of its upper surface, said at least one non-conductive slot comprising two slots each being disposed lateral to the at least one conductor on a different side thereof.

34. The antenna component of claim 31, wherein said at least one conductor is straight and runs in the longitudinal direction of the substrate substantially on the edge of its upper surface, and said non-conductive slot is disposed only on one side of the at least one conductor.

35. The antenna component of claim 31, wherein said interconnecting conductor comprises at least one adapted to increase said conductor's inductance.

36. The antenna component of claim 31, further comprising at least one bend in said non-conductive slot adapted to increase the capacitance between the head part and the tail part.

37. An antenna component of claim 31, wherein said dielectric substrate comprises a ceramic material.

38. A radio device, said device comprising a circuit board, a conductive surface of which functions as a ground plane, and an antenna, the antenna comprising an antenna component having at least a lower and an upper operating band, said component comprising:

a dielectric substrate with a longitudinal and a transverse direction; and a conductive coating of the substrate forming a radiating element having a feed end for signal communication with a feed conductor of the antenna;

wherein the radiating element is formed into at least a head part and a tail part, said head part proximate said feed end, said head and tail parts being coupled to each other only through at least one interconnecting conductor formed from the conductive coating of the substrate, said at least one conductor providing an inductance between the head part and the tail part, said head and tail parts further being capacitively coupled to each other via at least one non-conductive slot on the substrate;

wherein said antenna component is disposed substantially on the circuit board with its lower surface against the circuit board and with the feed end of the radiating element is connected to the feed conductor of the antenna; and wherein said ground plane is arranged a prescribed distance away from said dielectric element at least on one side.

39. The device of claim 38, wherein an edge of the ground plane is disposed at a prescribed distance from the antenna component in the direction of the normal of its side in order to match and tune the antenna.

40. The device of claim 38, wherein the head part forms, together with the substrate and the ground plane, a quarter wave resonator, which has a resonance in the upper operating band, and the whole radiator forming, together with the substrate and the ground plane, a quarter wave resonator, which has a resonance in the lower operating band.

41. The device of claim 38, further comprising a coil connected between the feed conductor and the ground plane to match the antenna.

42. An antenna component for implementing an antenna of a radio device, the antenna having at least a lower and an upper operating band, said component comprising:

a dielectric substrate with a longitudinal and a transverse direction; and a conductive coating of the substrate forming a radiating element having a feed end for signal communication with a feed conductor of the antenna;

wherein the radiating element is formed into at least a head part and a tail part, said head part proximate said feed end, said head and tail parts being coupled to each other only through at least one interconnecting conductor formed from the conductive coating of the substrate, said at least one conductor providing an inductance between the head part and the tail part, said head and tail parts further being capacitively coupled to each other via at least one non-conductive slot on the substrate;

wherein said at least one conductor is substantially straight and runs in said longitudinal direction of the substrate in substantially central area of its upper surface, said at least one non-conductive slot comprising two slots each being disposed lateral to the at least one conductor on a different side thereof.

43. An antenna component for implementing an antenna of a radio device, the antenna having at least a lower and an upper operating band, said component comprising:

a dielectric substrate with a longitudinal and a transverse direction; and a conductive coating of the substrate forming a radiating element having a feed end for signal communication with a feed conductor of the antenna;

wherein the radiating element is formed into at least a head part and a tail part, said head part proximate said feed end, said head and tail parts being coupled to each other only through at least one interconnecting conductor formed from the conductive coating of the substrate, said at least one conductor providing an inductance between the head part and the tail part, said head and tail parts further being capacitively coupled to each other via at least one non-conductive slot on the substrate;

wherein said at least one conductor is straight and runs in the longitudinal direction of the substrate substantially on the edge of its upper surface, and said non-conductive slot is disposed only on one side of the at least one conductor.

44. An antenna comprising:

a dielectric element having a longitudinal direction and a transverse direction, said element being deposited at least partially on a ground plane; wherein said ground plane is arranged a distance away from said dielectric element at least on one side;

a conductive coating deposited on the dielectric element, the conductive coating having a first portion and a second portion;

a ground structure;

a feed structure coupled to at least one of the first portion and the second portion, wherein said feed structure and said ground structure forming a single connection; and a resonant structure formed between the first portion and the second portion to electrically isolate the first portion and the second portion at a first frequency, and to form first and second resonators.

45. A radio frequency device comprising:

a multi-band antenna deposited on a dielectric substrate, the multi-band antenna comprising a first portion and a second portion;

wherein all of said second portion and at least the radiating part of said first portion are disposed substantially on the same plane and said first portion and said second portion are arranged to cause inductance and capacitance disposed in parallel between said first and second portions;

a resonant structure formed between the first portion and the second portion to electrically isolate the first portion and the second portion within a first frequency band, and to form a first resonator and a second resonator;

wherein the first resonator and the second resonator are substantially electrically isolated from each another with respect to at least frequency tuning.

* * * * *